US011589168B2

(12) United States Patent
Walther et al.

(10) Patent No.: US 11,589,168 B2
(45) Date of Patent: Feb. 21, 2023

(54) ACTUATOR FOR GENERATING STRUCTURE-BORNE SOUND

(71) Applicant: Continental Engineering Services GmbH, Frankfurt (DE)

(72) Inventors: Christian Walther, Frankfurt am Main (DE); Dimitrios Patsouras, Frankfurt am Main (DE); Robert Joest, Frankfurt am Main (DE); Stephan Eisele, Frankfurt am Main (DE); Johannes Kerkmann, Frankfurt am Main (DE); Karsten Moritz, Frankfurt am Main (DE); Pascal Köhler, Frankfurt am Main (DE); Robert Wick, Frankfurt am Main (DE); Jens Friedrich, Frankfurt am Main (DE)

(73) Assignee: Continental Engineering Services GmbH

( * ) Notice: Subject to any disclaimer, the term of this patent is extended or adjusted under 35 U.S.C. 154(b) by 0 days.

(21) Appl. No.: 17/123,884

(22) Filed: Dec. 16, 2020

(65) Prior Publication Data

US 2021/0195337 A1 Jun. 24, 2021

(30) Foreign Application Priority Data

Dec. 20, 2019 (DE) ..... 10 2019 220 476.7

(51) Int. Cl.
*H04R 9/06* (2006.01)
*H04R 9/02* (2006.01)
*H04R 9/04* (2006.01)

(52) U.S. Cl.
CPC ..... *H04R 9/06* (2013.01); *H04R 9/025* (2013.01); *H04R 9/04* (2013.01)

(58) Field of Classification Search
CPC ..... H04R 5/02; H04R 1/026; H04R 2440/05; H04R 1/02; H04R 1/2811; H04R 7/045;
(Continued)

(56) References Cited

U.S. PATENT DOCUMENTS 5,461,193 A * 10/1995 Schertler ..... H04R 1/46 84/727
5,625,701 A * 4/1997 Scanlan ..... H04R 7/16 381/403

(Continued)

FOREIGN PATENT DOCUMENTS

CN 105430577 A 3/2016
DE 102016217487 A1 3/2018

(Continued)

OTHER PUBLICATIONS

Extended European Search Report for European Application No. 20 211.836.0, dated May 14, 2021, 10 pages.

(Continued)

*Primary Examiner* — Angelica M McKinney
(74) *Attorney, Agent, or Firm* — RatnerPrestia

(57) ABSTRACT

An actuator, including an electric drive for converting electrical signals into mechanical deflections, the drive having a coil through which the current of the electrical signal can flow, and having a permanent magnet which can be in electromagnetic interaction with the coil, the actuator furthermore has a housing and a flat body, the flat body being able to be mechanically deflected and/or mechanically excited into vibration by the electric drive and, in the process, being able to radiate acoustic sound signals, wherein the flat body is connected integrally to at least part of the housing and at least part of the drive is connected to the flat body.

13 Claims, 3 Drawing Sheets

(58) Field of Classification Search
CPC ..... H04R 1/028; H04R 9/025; H04R 9/06; H04R 2499/15; H04R 1/2888; H04R 1/025; H04R 9/02; H04R 2400/11; H04R 2400/03; H04R 2499/11; H04R 9/04; H04R 2499/13; H04R 9/045; H04R 15/00; H04R 1/021; H04R 9/046; H04R 11/02; H04R 31/00; B60Q 5/008; B60R 11/0217; B60R 2011/004; B60R 11/02; B60R 11/0223; G10K 9/20; G10K 9/12; G10K 9/13; B06B 1/0622; B06B 1/0666; F16F 7/1011; H05K 5/0017; G02F 1/133314; G02F 1/13332; G02F 1/133331; G09F 9/00; G06F 1/1626; G06F 1/163; G06F 1/1688; G06F 3/016; B29C 43/18; B29C 45/14; B29C 45/14778; B29K 2105/258; B29L 2031/3041; B29L 2031/3418; Y10T 29/49005
See application file for complete search history.

(56) References Cited

U.S. PATENT DOCUMENTS 6,519,347 B1 * 2/2003 Morecroft ..... H04R 7/045 381/431
7,853,025 B2 * 12/2010 Sleboda ..... H04S 3/002 381/86
8,275,146 B2 * 9/2012 Beckley ..... H04R 1/025 381/86
9,818,805 B2 * 11/2017 Choi ..... G06F 1/1605
10,848,874 B2 * 11/2020 Landick ..... G06F 1/1688
2001/0012389 A1 8/2001 Marquiss
2003/0053375 A1 * 3/2003 Watanabe ..... H04R 1/44 367/131
2004/0129492 A1 * 7/2004 Bertagni ..... H04R 1/02 181/173
2006/0034467 A1 2/2006 Sleboda et al.
2006/0153406 A1 * 7/2006 Corynen ..... H04R 7/045 381/431
2007/0030985 A1 * 2/2007 Cheung ..... H04R 7/045 381/152
2009/0174213 A1 * 7/2009 Robertson ..... B62D 25/24 296/70
2010/0128889 A1 * 5/2010 Beckley ..... H04R 1/025 381/86
2010/0225142 A1 * 9/2010 Mazur ..... B60R 13/0243 296/146.7
2015/0365746 A1 * 12/2015 Cheung ..... H04R 7/10 381/152
2015/0373458 A1 * 12/2015 Newlove ..... H04R 9/066 381/400
2017/0280234 A1 * 9/2017 Choi ..... G06F 1/1605
2017/0280243 A1 * 9/2017 Choi ..... H04R 1/288
2019/0313194 A1 * 10/2019 Landick ..... H04R 1/2803
2022/0194303 A1 * 6/2022 Fay ..... H04R 1/025

FOREIGN PATENT DOCUMENTS

GB 2281836 A * 3/1995 ..... B60R 11/0217
WO 9709842 A2 3/1997
WO 2006078623 A1 7/2006

OTHER PUBLICATIONS

Chinese Office Action for Chinese Application No. 202011517961.1, dated Apr. 6, 2022 with translation, 15 pages.

* cited by examiner

ACTUATOR FOR GENERATING STRUCTURE-BORNE SOUND

CROSS REFERENCE TO RELATED APPLICATIONS

This application claims priority to German Patent Application No. 10 2019 220 476.7, filed Dec. 20, 2019, the contents of such application being incorporated by reference herein.

FIELD OF THE INVENTION

The invention relates to an actuator.

BACKGROUND OF THE INVENTION

Diverse structure-borne-sound actuators are known with which acoustic sound is generated via a flat body excited with structure-borne sound. There is potential here for improvement of high-range reproduction.

SUMMARY OF THE INVENTION

An aspect of the invention is an actuator which is robust and/or cost-effective and/or is particularly suitable for generating sound at frequencies of up to at least 18 kHz.

An aspect of the invention is preferably based on the concept of proposing an actuator, comprising an electric drive for converting electrical signals into mechanical deflections or mechanical vibrations, the drive having a coil through which the current of the electrical signal can flow or flows, and having a permanent magnet which can be or is in electromagnetic interaction with the coil, the actuator furthermore has a housing and a flat body, the flat body being able to be or being mechanically deflected and/or mechanically excited into vibration by the electric drive and, in the process, being able to radiate acoustic sound signals, wherein the flat body is connected integrally to at least part of the housing and at least part of the electric drive is connected to the flat body.

The electrical signals passing through the coil expediently contain the information of the sound signal to be radiated, in particular of a music signal.

It is preferred that the actuator, comprising the flat body, which is configured to radiate acoustic sound, is in particular in the form of a bending wave emitter and/or is designed in such a manner that the actuator excites or can excite the flat body into natural vibrations of its body structure, as a result of which the flat body which is surrounded by air emits sound waves.

The term "flat body" is preferably understood as meaning a body capable of vibrating in an acoustically usable manner and/or a body, the contour of which substantially consists of lateral surfaces, i.e. which is in particular not solid or compact, and/or is in the form of a shell-shaped body and/or the thickness thereof, in particular the thickness of the lateral surface thereof, is 2 cm or less, expediently 0.6 cm or less, wherein said thickness limit relates particularly preferably to at least 95% of its outer surface and/or lateral surface.

The flat body is expediently substantially plane or curved and/or multiply folded and/or multiply interrupted and/or multiply curved. The flat body is preferably in the form of a part or a segment of the interior trim of a motor vehicle.

It is expedient for the flat body and/or the housing, in particular the first and second housing part, to be formed from plastic, particularly preferably from thermoplastic, very particularly preferably from acrylonitrile-butadiene-styrene copolymer, ABS or from polyphenylene ether.

The flat body and the first housing part are preferably formed integrally as a common plastics injection molded part.

The actuator is preferably configured, in particular in respect of the flat body, as a structure-borne-sound transducer or structure-borne-sound exciter, which can emit sound acoustically via the flat body and is configured as a broadband and/or high-frequency transducer, which can generate sound frequencies of up to at least 18 kHz, particularly preferably a frequency response/amplitude response of −3 dB.

The drive preferably has the coil and a coil carrier, wherein the coil carrier and/or the coil are/is connected directly to the flat body, and in particular the coil carrier is partially injected into the flat body or is injection-molded onto the latter or fastened thereto by injection molding. The coil carrier here is expediently a frame, onto which the coil is wound.

It is preferred that a first housing part of the housing, in particular of substantially annular design, is connected integrally to the flat body, and said first housing part is expediently connected by means of at least one centering device to the permanent magnet, and the permanent magnet is mounted or suspended by means of the centering device so as to be capable of vibrating. The centering device is particularly preferably in the form of a centering spider and, very particularly preferably, the permanent magnet is suspended/mounted by means of two separate centering devices which are spaced apart and are in particular aligned substantially parallel to one another.

The first housing part is alternatively preferably formed with a substantially rectangular or polygonal and here rounded base surface, in particular in the form of a ring. The rectangular base surface is particularly preferably designed here in such a manner that the one side length is at least three times or ten times as long as the other.

The permanent magnet is expediently formed on the basis of neodymium or comprises a neodymium-based alloy. Alternatively preferably, the permanent magnet comprises a ferrite-based alloy.

It is expedient for the permanent magnet to have an outer ring and a base and also an inner part which here comprises in particular a first and a second disk-shaped part. An air gap in the form of a slot-shaped recess is formed in an encircling manner between the ring part of the permanent magnet and the inner part of the permanent magnet. The permanent magnet is particularly preferably substantially cylindrical. Very particularly preferably, the inner part of the permanent magnet comprises a neodymium alloy and the other parts of the permanent magnet are formed from iron or a ferromagnetic material.

The first housing part preferably together with a second housing part of the housing forms a substantially closed and/or sealed housing.

It is preferred that the first housing part is connected to the second housing part by means of a form-fitting connection, in particular by means of a latching connection and/or clip connection. Said latching connection and/or clip connection is particularly preferably releasable.

Alternatively preferably, the first housing part is connected to the second housing part by means of an integrally bonded connection, such as, for example, by means of welding or ultrasonic welding or friction welding, or by means of adhesive bonding.

It is expedient that the actuator is designed in such a manner, and the permanent magnet is mounted/suspended in such a manner, that the permanent magnet is positioned in respect of its undeflected state with its center of gravity substantially in the region of the plane of the radiating surface of the flat body. This plane is defined in particular as the tangential plane to the surface/lateral surface of the body in the region where the housing is connected to the flat body.

The first and the second housing part are preferably designed and arranged in such a manner that they interrupt the plane of the radiating surface of the flat body or emerge on both sides of the flat body or from the lateral surface thereof.

Alternatively preferably, the actuator is designed in such a manner that the first and the second housing part are formed and arranged on the flat body in a manner protruding to a single side, in particular on one side with respect to the plane of the radiating surface.

Expediently, the first housing part is formed on the flat body, in particular in a manner protruding exclusively to one side from the surface thereof, particularly preferably in a manner not entering into the surface or the tangential plane of the surface of the flat body, and the second housing part is very particularly preferably arranged connected to the first housing part in a manner likewise protruding to said single side.

The actuator preferably has a seal between the first and the second housing part, for example a labyrinth seal or an annular elastic seal, in particular made of elastomer or rubber.

The flat body preferably has a substantially plane radiating surface and/or a surface with an angular curvature of less than 20°, in particular in the region of the housing connected to the flat body.

The flat body is preferably in the form of an interior trim part or exterior paneling part or body part of a motor vehicle.

The first and/or the second housing part have/has at least one ventilation opening, to avoid compression.

An aspect of the invention also relates to the use of the actuator for acoustic generation of sound in motor vehicles.

REFERENCE SIGNS

1 Drive
2 Coil
3 Permanent magnet
4 Flat body
5 First housing part
6 Second housing part
7 Centering device
8 Ventilation openings
9 Groove
10 Plane of the radiating surface
11 Slot-shaped air gap
12 First disk-shaped part of the permanent magnet
13 Base of the permanent magnet
14 Outer ring of the permanent magnet
15 Second disk-shaped part of the permanent magnet

DETAILED DESCRIPTION OF THE PREFERRED EMBODIMENTS

Figure 1:
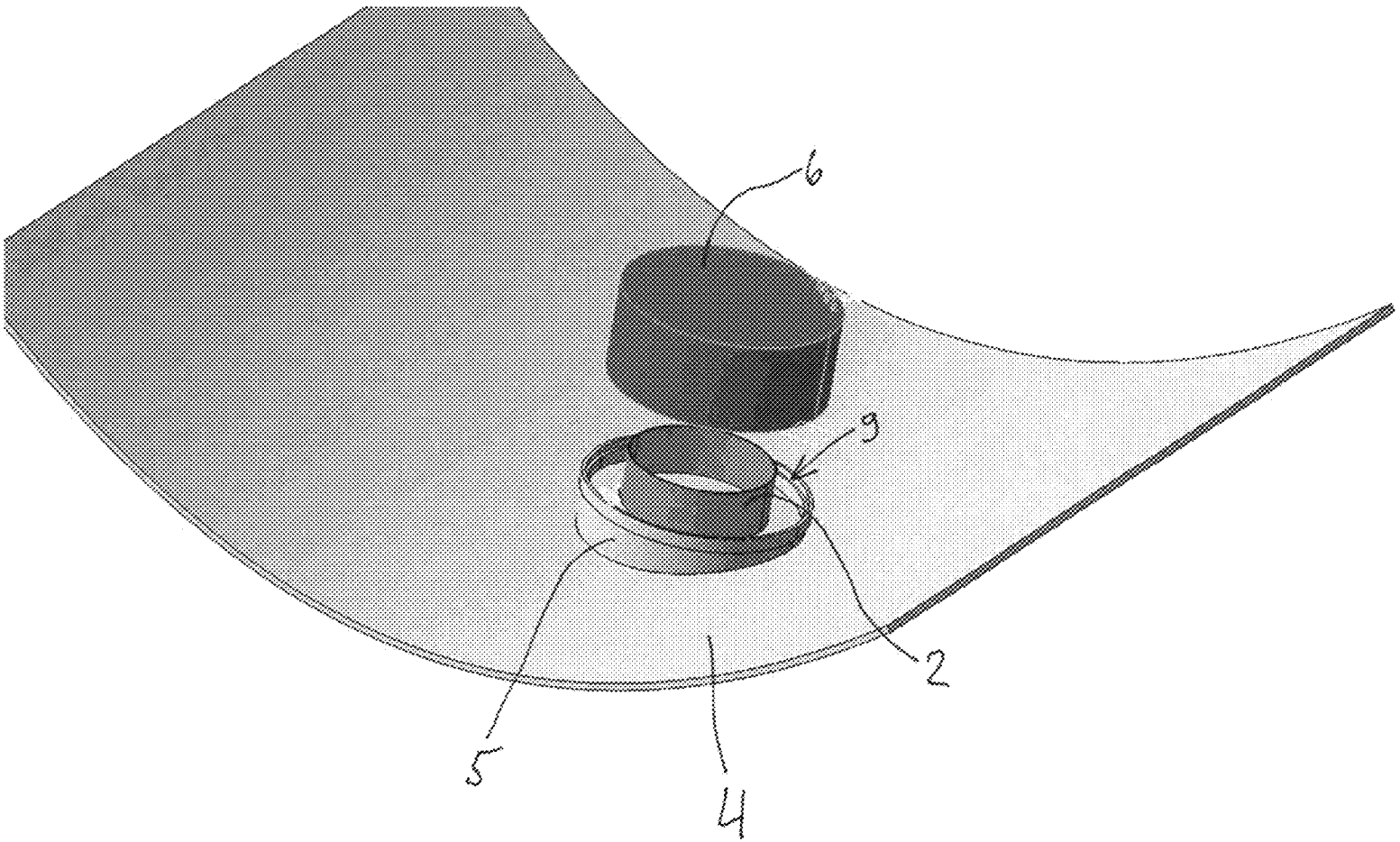
FIG. 1 shows an exemplary actuator, in which the first housing part is formed integrally on the flat body in a manner protruding on one side.

FIG. 1 shows a curved, flat body 4, on the one outer surface of which first housing part 5 is integrally formed. Flat body 4 and first housing part 5 are formed as a common plastics injection molded part. The inner lateral surface of the first housing part has a, for example encircling, groove 9 to which the second housing part 6 is or can be latched or connected in a form-fitting manner. In the interior of the first and second housing part 5, 6 there is arranged a coil 2 which is connected directly to the flat body 4 or is fixed directly thereon, for example by injection molding with plastic.

Figure 2:
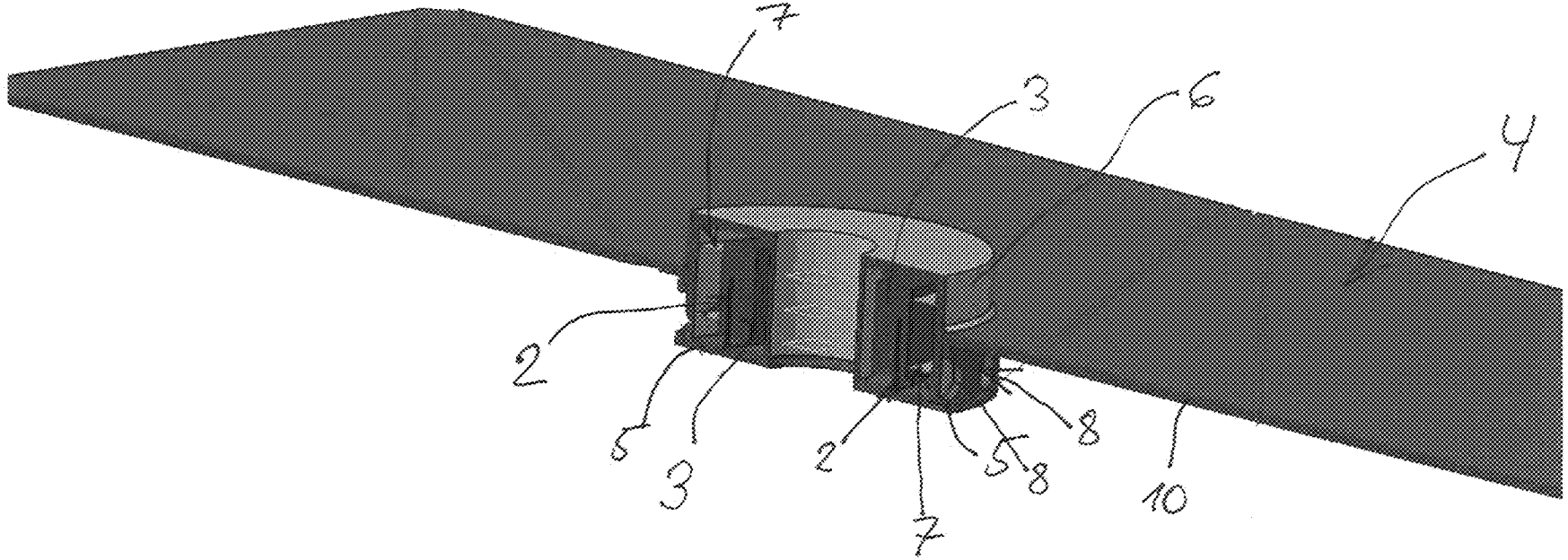
FIG. 2 shows an exemplary embodiment of the actuator, in which the first and the second housing part are formed and arranged in such a manner that they interrupt the plane of the radiating surface of the flat body.

FIG. 2 shows an exemplary embodiment of the actuator, in which the first and the second housing part 5, 6 are formed and arranged in such a manner that they interrupt the plane 10 of the radiating surface of the flat body 4.

The thickness of the lateral surface of said body or of the radiating surface 10 is by way of example less than 0.6 cm. First housing part 5 is connected integrally to flat body 4 and has ventilation openings 8. The first and second housing parts 5, 6 are connected to each other in a form-fitting manner and form a substantially annular housing. Permanent magnet 3 is suspended on first housing part 5 by means of two separate centering devices 7 so as to be capable of vibrating. Coil 2 is fastened directly on flat body 4 and enters into an encircling air gap of the permanent magnet 3.

Figure 3:
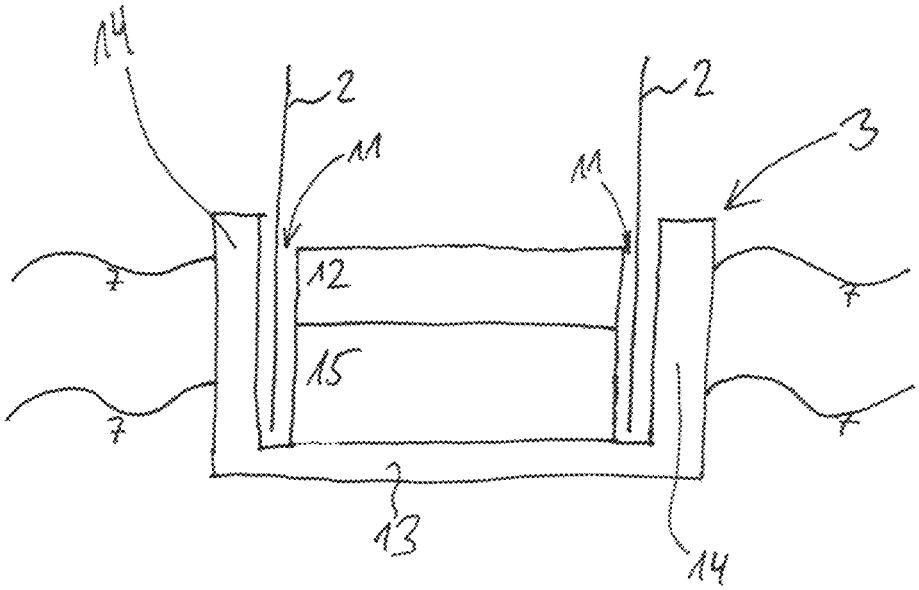
FIG. 3 shows an exemplary embodiment of the drive.

An exemplary drive is illustrated by means of FIG. 3. Permanent magnet 3 has by way of example a cylindrical form with an encircling, slot-shaped air gap 11. The inner part of the permanent magnet is divided into two, a first disk-shaped part 12 is in the form, for example, of a pole plate of the permanent magnet, for example made of iron or a ferromagnetic material. An inner, second disk-shaped part 15 of the inner part of the permanent magnet is formed from a neodymium alloy and is arranged on the base 13 of the permanent magnet.

The first disk-shaped part 12 is arranged on that side of the second disk-shaped part 15 of the permanent magnet that faces away from the base 13. The base 13 and the outer ring 14 are formed from iron or a ferromagnetic material.

The inner part 12, 15 of the permanent magnet is cylindrical and its lateral surface is surrounded by air gap 11. Coil 2 enters into air gap 11. Permanent magnet 3 is suspended by its outer lateral surface of the outer ring 14 on two separate centering devices 7 which are spaced apart from each other and are aligned substantially parallel to each other in the undeflected state. Permanent magnet 3 therefore comprises an outer ring 14 and a base 13 and also an inner part which has the first and second disk-shaped parts 12 and 15. The air gap 2 is formed in an encircling manner as a slot-shaped recess between ring 14 and inner parts 12 and 15.

The invention claimed is:

1. An actuator, comprising:

an electric drive converting electrical signals into mechanical deflections, the electric drive including a coil through which the current of the electrical signal flows, and including a permanent magnet in electromagnetic interaction with the coil;

a flat body including a first plane, a second plane opposite the first plane, and a first housing formed integrally with the flat body as an integral molded part, the first housing configured to receive the electric drive by interrupting both the first plane and the second plane of the flat body and surrounding a first portion of the electric drive positioned within the first housing, the first housing being connected to the first portion of the electric drive; and a second housing formed separate from the first housing, the second housing interrupting both the first plane and the second plane of the flat body and connected to the first housing to surround a second portion of the electric drive, the electric drive enclosed between the first housing and the second housing, wherein the flat body is mechanically deflected and/or mechanically excited into vibration by the electric drive to radiate acoustic sound signals.

2. The actuator as claimed in claim 1, wherein the drive has the coil and a coil carrier, wherein the coil carrier and/or the coil are/is connected directly to the flat body.

3. The actuator as claimed in claim 2, wherein the first housing, is connected integrally to the flat body, and said first housing is connected by at least one centering device to the permanent magnet, and the permanent magnet is mounted by the centering device so as to be capable of vibrating.

4. The actuator as claimed in claim 1, wherein the first housing is connected integrally to the flat body, and said first housing is connected by at least one centering device to the permanent magnet, and the permanent magnet is mounted by the centering device so as to be capable of vibrating.

5. The actuator as claimed in claim 1, wherein the first housing together with the second housing forms a sealed housing.

6. The actuator as claimed in claim 1, wherein the first housing is connected to the second housing by a form-fitting connection.

7. The actuator as claimed in claim 1, wherein the actuator is designed in such a manner, and the permanent magnet is mounted in such a manner, that the permanent magnet is positioned in respect of an undeflected state and has a center of gravity in a region of the plane of the flat body.

8. The actuator as claimed in claim 1, wherein the first housing and the second housing are designed and arranged in such a manner that they interrupt the plane of a radiating surface of the flat body.

9. The actuator as claimed in claim 1, wherein the actuator is designed in such a manner that the first and the second housing are arranged on one side of the flat body, with respect to the plane of a radiating surface.

10. The actuator as claimed in claim 1, wherein the actuator has a seal between the first housing and the second housing.

11. The actuator as claimed in claim 1, wherein the flat body has a plane radiating surface and/or a surface with an angular curvature of less than 20°, in a region of the housing connected to the flat body.

12. The actuator as claimed in claim 1, wherein the flat body is in a form of an interior trim part of a motor vehicle.

13. The actuator as claimed in claim 1, wherein the first housing is connected to the second housing by a latching connection and/or clip connection.

* * * * *